US008018156B2

(12) United States Patent
Graser et al.

(10) Patent No.: US 8,018,156 B2
(45) Date of Patent: Sep. 13, 2011

(54) HIGH-PRESSURE DISCHARGE LAMP HAVING A CERAMIC DISCHARGE VESSEL

(75) Inventors: Wolfram Graser, München (DE); Dieter Trypke, Falkensee (DE)

(73) Assignee: Osram AG, Munich (DE)

( * ) Notice: Subject to any disclaimer, the term of this patent is extended or adjusted under 35 U.S.C. 154(b) by 364 days.

(21) Appl. No.: 12/224,226

(22) PCT Filed: Feb. 14, 2007

(86) PCT No.: PCT/EP2007/051414

§ 371 (c)(1),
(2), (4) Date: Aug. 21, 2008

(87) PCT Pub. No.: WO2007/096277

PCT Pub. Date: Aug. 30, 2007

(65) Prior Publication Data

US 2009/0021172 A1 Jan. 22, 2009

(30) Foreign Application Priority Data

Feb. 22, 2006 (DE) ..... 20 2006 002 833 U

(51) Int. Cl.
*H01J 17/04* (2006.01)
*H01J 61/04* (2006.01)

(52) U.S. Cl. ..... 313/631; 313/623; 313/630; 313/633; 313/621

(58) Field of Classification Search ..... 313/623–625, 313/634–636, 493, 318.12, 570, 631, 633
See application file for complete search history.

(56) References Cited

U.S. PATENT DOCUMENTS

| | | | | |
|---|---|---|---|---|
| 5,424,608 | A * | 6/1995 | Juengst et al. | 313/623 |
| 5,424,609 | A * | 6/1995 | Geven et al. | 313/623 |
| 5,446,341 | A * | 8/1995 | Hofmann et al. | 313/623 |
| 5,808,398 | A * | 9/1998 | Stoffels et al. | 313/25 |
| 5,955,845 | A * | 9/1999 | Fellows | 315/189 |
| 5,973,453 | A * | 10/1999 | Van Vliet et al. | 313/623 |
| 5,994,839 | A * | 11/1999 | Yamamoto et al. | 313/570 |
| 6,147,453 | A * | 11/2000 | Geijtenbeek et al. | 313/640 |
| 6,208,070 | B1 * | 3/2001 | Sugimoto et al. | 313/493 |
| 6,211,615 | B1 | 4/2001 | Altmann et al. | |

(Continued)

FOREIGN PATENT DOCUMENTS

DE 42 06 002 A1 9/1993

(Continued)

*Primary Examiner* — Nimeshkumar D Patel
*Assistant Examiner* — Jose M Diaz

(57) ABSTRACT

High-pressure discharge lamp having a ceramic discharge vessel, in which two electrodes and a light-emitting filling are contained, wherein capillaries are positioned at the ends of the discharge vessel, in which capillaries leadthroughs are sealed off, which leadthroughs are each connected to an electrode (15) consisting of tungsten. The electrode (15) is in the form of a pin and integrally comprises two parts (25, 26) having different diameters, wherein the first part (25) having a given diameter D1 forms the electrode tip, the second part (26) having a diameter D2 is positioned in the capillary, and the diameter D2 of the second part makes up at least 108% of the diameter D1 of the first part. The total length L of the electrode (15) is split between the first part (25) with a partial length L1 and the second part (26) with a partial length L2 such that L2 makes up approximately 30 to 70% of the total length L, wherein the beginning of the maximum diameter D2 coincides with the beginning of the capillary or deviates therefrom by a maximum of 10% of the length L.

9 Claims, 3 Drawing Sheets

U.S. PATENT DOCUMENTS

| | | | | |
|---|---|---|---|---|
| 6,215,254 | B1 * | 4/2001 | Honda et al. | 315/246 |
| 6,307,321 | B1 * | 10/2001 | Honda et al. | 313/634 |
| 6,362,569 | B1 * | 3/2002 | Wijenberg et al. | 313/634 |
| 6,404,129 | B1 * | 6/2002 | Hendricx et al. | 313/620 |
| 6,469,442 | B2 * | 10/2002 | Kakisaka et al. | 313/634 |
| 6,525,476 | B1 * | 2/2003 | Geijtenbeek et al. | 313/640 |
| 6,657,388 | B2 * | 12/2003 | Wijenberg et al. | 313/623 |
| 6,781,292 | B2 * | 8/2004 | Ishida et al. | 313/284 |
| 6,812,642 | B1 * | 11/2004 | Niimi | 313/623 |
| 6,984,938 | B2 * | 1/2006 | Kakisaka et al. | 313/631 |
| 7,795,814 | B2 * | 9/2010 | Maya | 313/634 |
| 2002/0008476 | A1 * | 1/2002 | Fidler et al. | 313/623 |
| 2002/0117965 | A1 * | 8/2002 | Kotter et al. | 313/573 |
| 2003/0062838 | A1 * | 4/2003 | Niimi | 313/634 |
| 2004/0036393 | A1 * | 2/2004 | Eastlund et al. | 313/26 |
| 2004/0124776 | A1 * | 7/2004 | Iorio et al. | 313/625 |
| 2005/0007020 | A1 * | 1/2005 | Tsuda et al. | 313/634 |
| 2005/0264213 | A1 * | 12/2005 | Dambacher et al. | 313/631 |
| 2005/0280370 | A1 * | 12/2005 | Henning et al. | 313/631 |
| 2006/0049760 | A1 * | 3/2006 | Lenz et al. | 313/624 |
| 2006/0214587 | A1 * | 9/2006 | Trypke | 313/623 |
| 2008/0116806 | A1 * | 5/2008 | Van Eysendeyk et al. | 313/623 |

FOREIGN PATENT DOCUMENTS

| | | | |
|---|---|---|---|
| DE | 197 49 908 | A1 | 5/1999 |
| EP | 0 639 853 | B1 | 2/1995 |
| JP | 5-82086 | A | 4/1993 |
| JP | 11-135073 | A | 5/1999 |
| WO | 2005/017948 | A2 | 2/2005 |
| WO | WO 2006046704 | A1 * | 5/2006 |

* cited by examiner

HIGH-PRESSURE DISCHARGE LAMP HAVING A CERAMIC DISCHARGE VESSEL

TECHNICAL FIELD

The invention is based on a high-pressure discharge lamp having a ceramic discharge vessel in accordance with the preamble of claim 1. This may involve high-pressure discharge lamps as are used in particular for general lighting.

PRIOR ART

EP-B 639 853 has disclosed a metal-halide lamp, in which the dead volume in the ceramic discharge vessel, which has a capillary for accommodating the leadthrough, is reduced by virtue of the fact that an electrode made from tungsten has a very long shaft, which reaches into the capillary. In this case, the relatively thin shaft is sheathed by a sleeve, which is matched to the inner diameter of the capillary.

DESCRIPTION OF THE INVENTION

The object of the present invention is to provide a high-pressure discharge lamp in accordance with the preamble of claim 1 in which the risk of damage to the electrode is minimized. In addition, it is desired to extend the life.

These objects are achieved by the characterizing features of claim 1. Particularly advantageous refinements are given in the dependent claims.

The invention describes an electrode system for AC HID lamps, comprising a tungsten electrode, which comprises a rotationally symmetrical body and is split into two parts with different diameters, and a leadthrough positioned thereon, which is arranged in a capillary. The invention reduces the dead volume in the capillary in a very reliable manner and with a high degree of accuracy.

Preferably, a welded joint is provided between the electrode and the leadthrough. This welded joint is brought to an uncritical temperature by the length of the electrode, which protrudes far into the capillary. As a result, the risk of the electrode breaking or bending back as a result of temperature influences is reduced.

In detail, the invention describes a high-pressure discharge lamp having a ceramic discharge vessel, in which two electrodes and a light-producing filling are contained, capillaries resting at the ends of the discharge vessel, in which capillaries leadthroughs are sealed off, which leadthroughs are each connected to an electrode made from tungsten. In this case, the electrode is in the form of a pin and integrally comprises two parts with different diameters, the first part with a given diameter D1 forming the electrode tip, and the second part with a diameter D2 resting in the capillary, the diameter D2 of the second part making up at least 108% of the diameter of the first part, the total length L of the electrode thus being split between the first part with a part length L1 and the second part with a part length L2, with L2 making up approximately 30 to 70% of the total length L, and the beginning of the maximum diameter D2 coinciding with the beginning of the capillary or deviating from this by a maximum of 10% of the length L.

Preferably, the diameter D2 of the second part is at least 95% of the inner diameter ID of the capillary, with the result that the dead volume is minimized.

In particular, the second part is connected to the leadthrough by means of welding. It is further recommended for the diameter of the leadthrough to correspond to the diameter of the second part to an accuracy of at least 10%.

In this case, the transition between D1 and D2 can take place suddenly by means of a step, but it may also be beveled, with the result that there is a gradual transition.

Since the electrode is manufactured from one piece, the diameter D2 should make up a maximum of 150% of D1, since otherwise too much waste is produced.

Optimum thermal management can be achieved by virtue of the fact that an additional thickened portion is fitted on the first part in the vicinity of the tip. This thickened portion may be an integral head, or else a coil, which is pushed onto the first part. It is preferred for it to be the integral head, since it can be produced easily in one working step, which reduces waste. Preferably, the maximum diameter of the head is therefore the same as that of the second part. The thermal capacity can be set via the length of the head. Alternatively, the diameter of the head, D3, can be between D1 and D2.

Preferably, the electrode and the electrode system are used for high-pressure discharge lamps whose filling contains metal halides.

Advantageously, the ratio of the diameters of the first and second parts of the electrode can now be set very precisely and in particular can be set in such a way that the second part is matched closely to the inner diameter of the capillary. In particular, the values should be between 1.3 and 1.6. A typical value is a factor of 1.4.

An electrode head, which can in particular also be realized by a filament, a sleeve or a solid thickened portion, as is known per se, often rests on the first part. The electrode head may, however, also be a pin without a thickened portion.

Different requirements are placed on the diameter of the first part of the electrode which faces the plasma than on the larger diameter of the rear, second part facing the fuse seal. The electrode is preferably produced from tungsten or a similarly high-melting material, in particular a compound containing a high quantity of tungsten.

The front first part of the tungsten electrode which faces the plasma is intended to dissipate precisely so much heat that the temperature of the electrode tip, firstly, is not so hot that an unnecessarily high degree of vaporization of tungsten takes place, and secondly the heat dissipation is intended to be not so great that sputtering occurs in the cathode phase (AC operation). These requirements fix an optimum for the diameter of the tungsten electrode tip in the front part.

Other criteria apply for the optimum diameter of the rear part, namely the shaft part of the electrode which faces the fuse seal. The optimum diameter is primarily determined by the capacity of the shaft part to be joined to the cermet, molybdenum, Nb(Zr) and/or other conceivable capillary lead-through component parts in the direction of a glass solder fuse seal. These requirements fix an optimum for the diameter of the second part. This optimum is determined by the condition that the ratio between the capillary leadthrough and the electrode shaft part is preferably between 0.5 and 1.0, including limit values.

Electrodes for discharge lamps according to the invention are manufactured from a metal which is resistant to high temperatures. Suitable metals are in particular tungsten, molybdenum, tantalum, rhenium or alloys thereof, or else carbides of these metals, in particular tantalum carbide (TaC).

The electrodes are produced from blanks with corresponding dimensions by means of turning on a lathe, grinding, drilling, etching, etc. Particularly preferred is a laser method as described in DE 42 06 002. In addition deformation work may also be introduced by means of suitable manufacturing processes such as rolling and hammering in order to increase the microstructure stability of the electrode materials. Metals which are resistant to high temperatures, such as W, Ta, Mo, Re or alloys thereof, some of which are additionally doped in order to increase the microstructure stability of the materials, are now used as the electrode materials. Preferably, the doping for the microstructure stabilization takes place with elements such as, for example, K, Al and Si and in addition with oxides, carbides, borides, nitrides and/or the pure metals (or alloys thereof) of rare earth elements, of the lanthanoids, the actinoids, such as, for example, La, Ce, Pr, Nd, Eu, Th, but also Sc, Ti, Y, Zr, Hf. They are used not only for the microstructure stabilization, but also for reducing the electron work function.

In a particularly preferred, first embodiment, integral electrodes are produced, in particular from tungsten, with it being possible for the complex contour to have a rear shaft part as the second part, which is cylindrical, and a front piece as the first part, which can have a head.

High-density bodies with typically 98% (even up to more than 99%) of the theoretical density can be produced.

In particular optimization of the heat flow response of electrodes is achieved thereby. The processing is in this case often purely mechanical using metal-cutting tools. Until now, it has been necessary to accept waste of up to approximately 60% for such electrodes. However, a laser sublimation process can favorably be applied here which is based on the details given in DE-A 42 06 002.

In particular, the shaft length of the tungsten electrode can now be designed to be fully variable. Until now the problem has been known that the joint between the two parts used earlier, which generally is a welded joint, is subject to an excessively high thermal load during lamp operation too close to the discharge. This is the case when the joint between the tungsten electrode and the leadthrough is positioned too close to the end of the capillary in the direction of the discharge volume. Until now it has been preferable to take care that the temperature at the joint is not above 1500 K, particularly preferably not above 1300 K. The result in this case is a bending-back of the tungsten electrode at the joint, which is generally a welded joint. If the tungsten electrode comes into contact with the inner wall of the capillary, cracks appear in the capillary through which the filling escapes from the discharge vessel. This shortens the life and the lamp is extinguished.

The different requirements placed on the two parts of the tungsten electrode are now best met by virtue of the fact that the electrode is integral and that the tungsten material is removed in the front first part of the tungsten electrode. This best takes place by means of mechanical, chemical or thermomechanical methods such as laser removal.

The present application is also based on a high-pressure discharge lamp with such an electrode, in particular with a metal-halide filling of the type already known from EP-A 1 056 115.

If the electrode is extended into the capillary without the diameter of the second part being increased in size, a very large dead volume is produced with the known negative consequences. This dead volume usually results in greater color temperature scatter, which in turn can only be compensated for by increasing the amount of filling. Increasing the amount of filling in turn results in an increase in the restart peak voltage. As a result, the risk of premature extinguishing of the lamp is increased.

The diameter of the second part is therefore intended to be matched as well as possible to the inner diameter of the capillary and thus to fill the dead volume. The end of the electrode can be moved as far as possible towards the rear into the capillary, up to 70% of the total length L of the electrode.

FIGURES

The invention will be explained in more detail with reference to a plurality of exemplary embodiments below. In the figures:

FIG. 1 shows a metal-halide lamp having a ceramic discharge vessel;

FIG. 2 shows an electrode in accordance with the invention in detail;

FIGS. 3-4 each show a further exemplary embodiment of an electrode in detail;

FIG. 5 shows the end region of the lamp in FIG. 1 with the electrode system in detail;

FIG. 6 shows a further exemplary embodiment of an electrode system.

Figure 1:
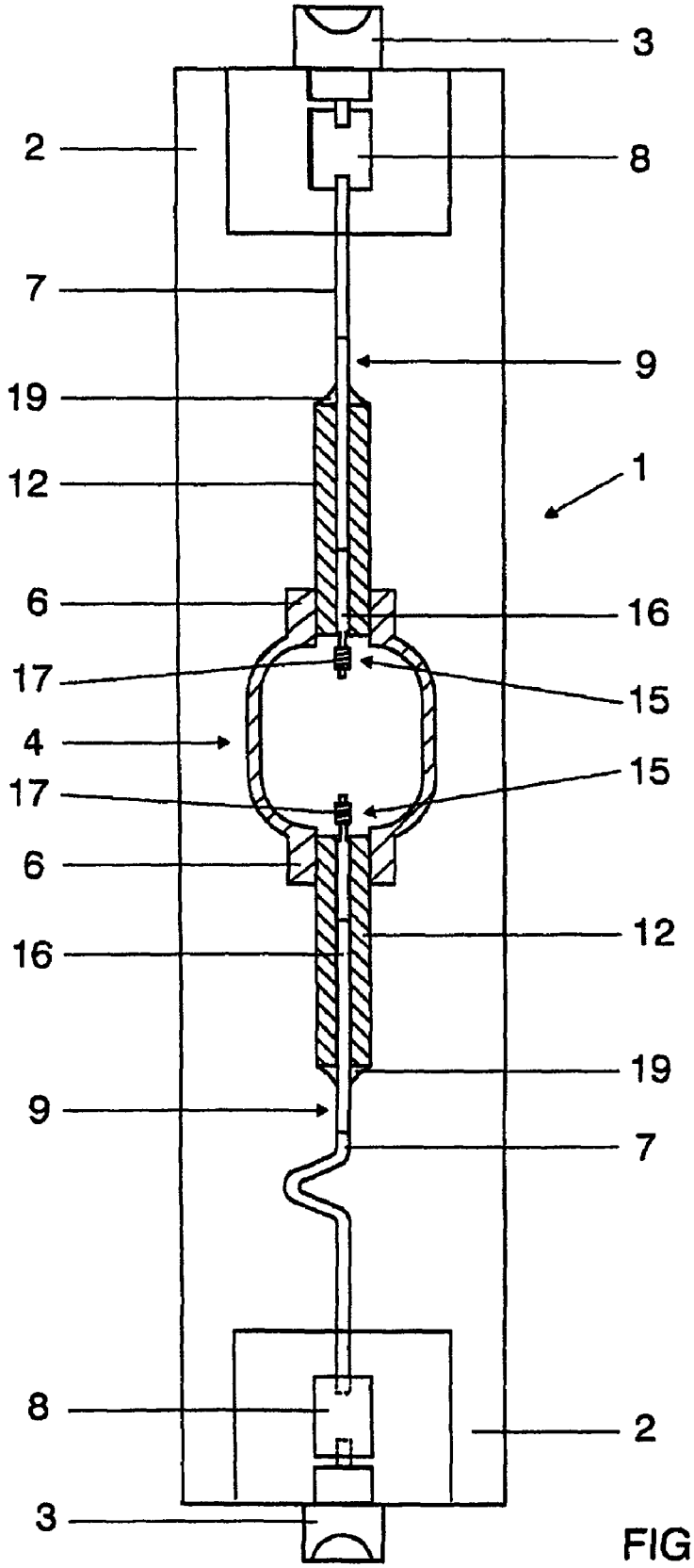
FIG. 1 illustrates, schematically, a metal-halide lamp with a power of 150 W. It comprises a cylindrical outer bulb 1 which is made from quartz glass, defines a lamp axis and has a pinch seal (2) and base (3) at two ends. The lamp can of course also be sealed at one end and be provided, for example, with a screw-type base. The axially arranged discharge vessel 4 made from $Al_2O_3$ ceramic is cylindrical or bulbous and has two ends 6. It is held in the outer bulb 1 by means of two power supply lines 7, which are connected to the base parts 3 via foils 8.

The power supply lines 7 are welded to leadthroughs 9, which are each fitted in an end stopper at the end 6 of the discharge vessel. The end stopper is in the form of an elongated capillary tube 12 (stopper capillary). The end 6 of the discharge vessel and the stopper capillary 12 are sintered directly to one another, for example. On the discharge side, an electrode 15 rests on the leadthrough.

The leadthrough 9 is in each case in the form of a multi-part pin and protrudes into the capillary tube 12 by up to three-quarters of the length thereof. A two-part electrode shaft 16 made from tungsten with a filament 17 pushed on at the discharge-side end extends thereon within the capillary tube 12 towards the discharge volume.

The filling of the discharge vessel comprises, in addition to an inert ignition gas, for example argon, mercury and additives of metal halides. It is also possible, for example, to use a metal-halide filling without any mercury, with it being possible for, for example, xenon to be selected as the ignition gas and for in particular a high pressure, markedly above 1.3 bar, to be selected.

The pin 9 is inserted into the stopper capillary 12 and sealed off by means of glass solder 19.

Figure 2:
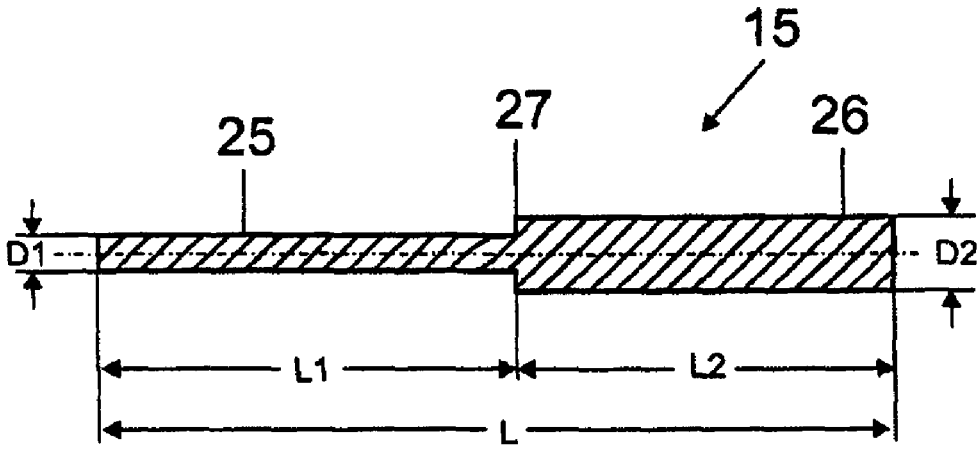

FIG. 2 shows an electrode 15 in detail. It is important that the electrode is an integral component part. The diameter of the front part 25 is D1 and the diameter of the rear part 26 is D2. The total length of the electrode is L. The length of the first part 25 is L1 and the length of the second part 26 is L2. The transition between the two parts is a step 27.

Figure 3:
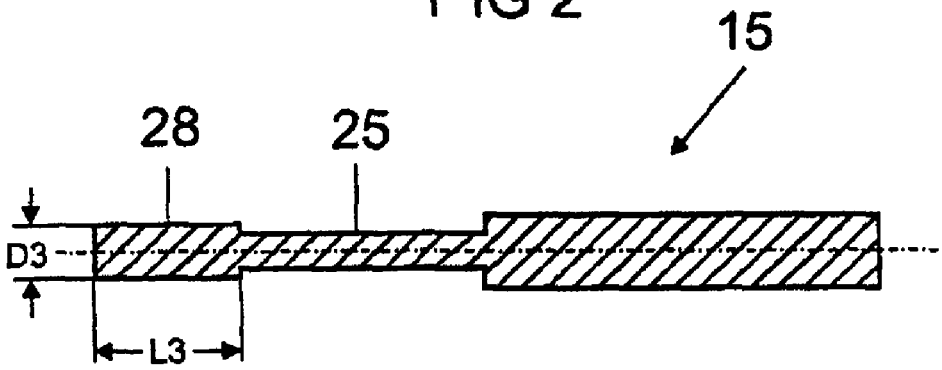

FIG. 3 shows an electrode 15, in which the first part 25 has a head 28, which is likewise produced integrally. Its diameter is D3, its length is L3. In this case, $D1 < D3 \leqq D2$.

Figure 4:
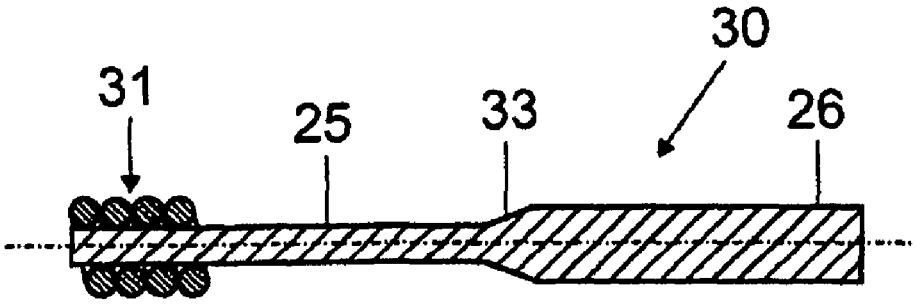

FIG. 4 shows an electrode 30, in which the head is a separate filament 31. It is further shown that a bevel 33 is used as the transition between the first part 25 and the second part 26.

Figure 5:
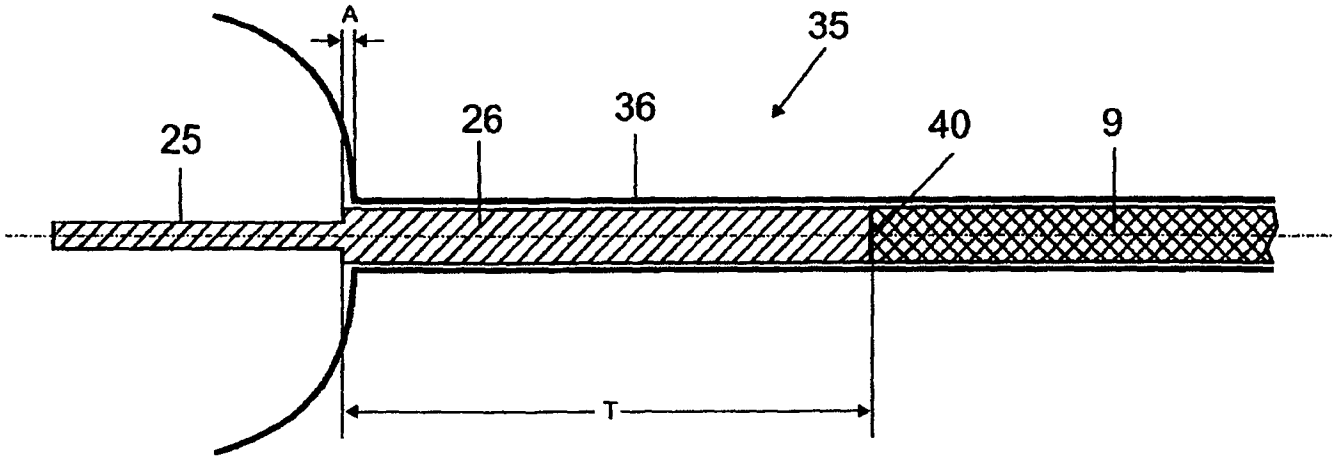

FIG. 5 shows the electrode system 35 in detail in the stopper 36. The leadthrough 9 used is a pin, for example also a two-part pin as shown in FIG. 6, whose first part 38 close to the discharge is a cermet consisting of Mo and $Al_2O_3$, and whose second part 39 consists of niobium or else NbZr or else MoV.

The leadthrough can also be partially sheathed by a filament, for example. The second part 26 of the electrode has approximately the same diameter as the pin and is welded to it. Adjacent to this is, on the discharge side, the first part 25, whose diameter is markedly smaller, the two parts being manufactured from one piece. The first part can be in the form of a pin or have a solid part or a filament as the head. In this case, the diameter of the second part is intended to be preferably at least 10%, a maximum of 60% larger than the diameter of the first part. The minimum value applies in particular if the electrode is in the form of a pin. The step 27 between the two parts is intended to coincide approximately with the end of the capillary. The mismatch A is intended to be less than 10% of the length L. A typical value for A is 1 mm.

Figure 6:
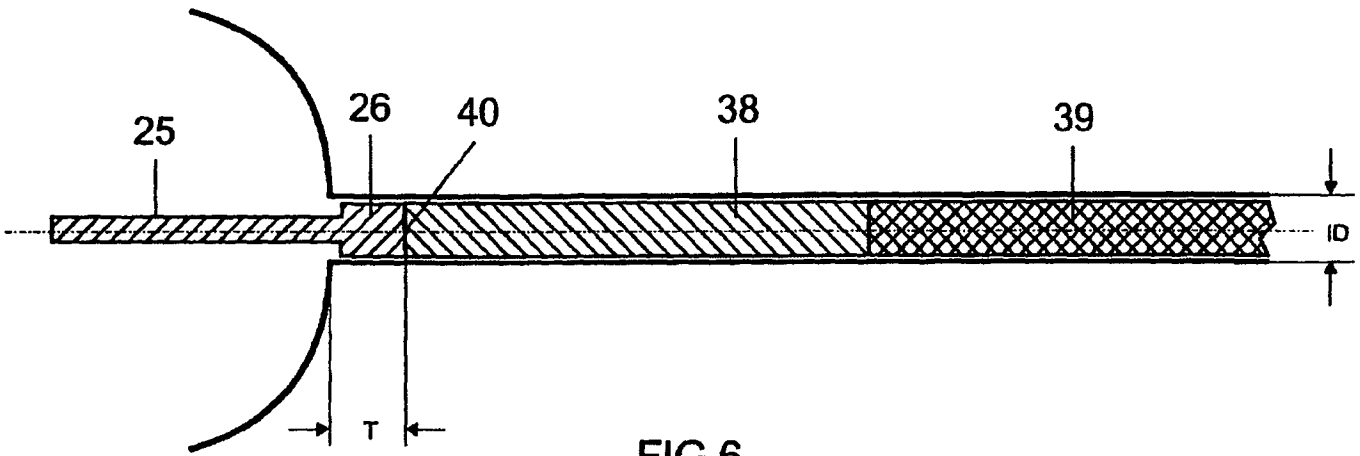

FIG. 6 shows a further exemplary embodiment of an electrode system in the capillary. It is preferred that the diameter D2 of the second part 26 of the electrode is between 120 and 140% of the diameter D1 of the first part 25. The diameter D2 of the second part should preferably be as close to the inner diameter ID of the capillary as possible. It should be at least 95% thereof, preferably at least 98% thereof.

The relative assignment in the axial direction is also important. In this case, it should be preferred that, based on the beginning of the capillary, the second part of the electrode is approximately flush or slightly recessed or protruding, i.e. for example inserted into the capillary in a depth A of up to 1 mm.

It is also advantageous that the joint 40 to the leadthrough rests as low as possible in the capillary. It should have a depth T of, for example, from 3 to 6 mm; this value is also dependent on the wattage of the lamp.

The leadthrough in particular comprises two parts, namely a cermet as the inner part and a niobium pin as the part which is positioned further outwards. The two parts of the leadthrough preferably have approximately the same diameter as the second part of the electrode and should deviate from this by a maximum of 10%. The dead volume is thus completely minimized.

Welding, but also mechanical fitting into a groove, etc., are possible joining techniques between the second part and the leadthrough. However, a welded joint is preferred since it provides the most secure hold.

The invention claimed is:

1. A high-pressure discharge lamp having a ceramic discharge vessel, in which two electrodes and a light-producing filling are contained, capillaries resting at the ends of the discharge vessel, in which capillaries leadthroughs are sealed off, which leadthroughs are each connected to an electrode made from tungsten, rhenium or a mixture or alloy of the two elements, possibly with an addition of conventional dopings, wherein the electrode is in the form of a pin and integrally comprises two parts with different diameters, the first part with a first given diameter forming the electrode tip, and the second part with a second given_diameter resting in the capillary, the second diameter of the second part making up at least 108% of the diameter of the first part, the total length of the electrode thus being split between the first part with its first_part length and the second part with its second part length, with the second part's part length making up approximately 30 to 70% of the total length of the electrode, and the beginning of the second_diameter coinciding with the beginning of the capillary or deviating from this by a maximum of 10% of the total length, wherein the second diameter makes up at most 160% of the first diameter.

2. The high-pressure discharge lamp as claimed in claim 1, wherein the second diameter of the second part is at least 95% of the inner diameter of the capillary.

3. The high-pressure discharge lamp as claimed in claim 1, wherein the second part is connected to the leadthrough by means of welding.

4. The high-pressure discharge lamp as claimed in claim 1, wherein the diameter of the leadthrough corresponds to the diameter of the second part to an accuracy of at least 10%.

5. The high-pressure discharge lamp as claimed in claim 1, wherein the transition between the first diameter and the second diameter takes place suddenly by means of a step.

6. The high-pressure discharge lamp as claimed in claim 1, wherein an additional thickened portion is fitted on the first part in the vicinity of the tip.

7. The high-pressure discharge lamp as claimed in claim 1, wherein the filling contains metal halides.

8. The high-pressure discharge lamp as claimed in claim 1, wherein the electrode material is doped with at least one of the elements K, Al, Si, Y.

9. The high-pressure discharge lamp as claimed in claim 1, wherein the transition between the first diameter and the second diameter takes place by means of a bevel.

* * * * *